United States Patent [19]

Trevithick

[11] 4,035,045

[45] July 12, 1977

[54] GROUNDING JACK

[75] Inventor: Tony Trevithick, Gurnee, Ill.

[73] Assignee: Daniel Woodhead, Inc., Northbrook, Ill.

[21] Appl. No.: 436,178

[22] Filed: Jan. 24, 1974

[51] Int. Cl.[2] ..... H01R 3/06; H01R 13/32

[52] U.S. Cl. ..... 339/14 R; 339/88 R; 339/130 R; 339/219 R; 339/259 R

[58] Field of Search ..... 339/14 R, 14 P, 88 R, 339/88 C, 181 R, 181 C, 188 R, 188 C, 177 R, 177 E, 189, 219, 255 R, 255 RT, 259 R

[56] References Cited

U.S. PATENT DOCUMENTS

| | | | |
|---|---|---|---|
| 1,101,939 | 6/1914 | Knauff | 339/188 C |
| 2,304,038 | 12/1942 | Thompson | 339/255 R |
| 2,502,302 | 3/1950 | Arson | 339/259 R |
| 2,704,357 | 3/1955 | Johnson | 339/130 C |
| 3,170,748 | 2/1965 | Van Horssen | 339/88 C |
| 3,184,703 | 5/1965 | Piscitello et al. | 339/88 C |
| 3,295,076 | 12/1966 | Kraus | 339/177 E |

FOREIGN PATENT DOCUMENTS

| | | | |
|---|---|---|---|
| 483,579 | 4/1938 | United Kingdom | 339/259 |

*Primary Examiner*—Roy Lake
*Assistant Examiner*—Neil Abrams
*Attorney, Agent, or Firm*—Johnson, Dienner, Emrich & Wagner

[57] ABSTRACT

A grounding jack, particularly useful in a patient load center of hospitals, and the like, is disclosed, wherein the male and female members thereof, when assembled, may be locked together by the non-current-carrying or insulated portions thereof, and the frictional engagement between the surfaces of the current-carrying portions is such that breakage of the locking means or inadvertent unlocking between the two members will not impair current flow.

4 Claims, 10 Drawing Figures

LOCK

GROUNDING JACK

BACKGROUND OF THE INVENTION

The invention relates to a grounding jack which is particularly useful in providing redundant grounding for a patient load center in hospitals and the like. When electrical equipment is used on a patient, suitable electrical receptacles are provided to furnish electric current to such equipment. Unless adequate grounding is provided for, there is always a danger to the patient. The regular U-blade plug provides ground to whatever equipment is being used, but it is customary and advisable to use a receptacle cluster as the patient load center, which has one or more grounding jacks for redundant grounding and which may be connected to the frame of the patient's bed or other metal furniture or to other equipment in the room. The jack is bussed together with the ground of the duplex receptacle so that there is a common ground and no potential voltage or current can follow a different path, such as through the patient.

Such grounding jacks comprise a female member which includes a current-carrying sleeve connected to ground, and a current-carrying male pin or plug to be inserted into the sleeve. The cable connected to the plug may then be attached to the bed frame or equipment. Interengaging parts on the plug and sleeve have been used for locking the parts together but this locking feature, heretofore, has been in the current-carrying parts of both the male and female members, so that if they become unlocked inadvertently or broken, no current will flow or at least much of the integrity of the current will be lost.

For example, the current-carrying plug had a radially extending locking pin which also carried current. The current-carrying sleeve had recesses therein, shaped to receive the locking pin and lock the two members in place by relative rotation thereof. A coiled compression spring within the sleeve exerted axial pressure on the plug to hold the parts together. Reliance was placed on the pin to carry the current and if the pin broke, little or no current could flow and because of the slip fit between the plug and sleeve, the parts could easily become separated and, therefore, dangerous to the patient.

BRIEF SUMMARY OF THE INVENTION

The invention is directed to a grounding jack which provides redundant grounding in patient load centers in hospitals and the like. One of the features resides in forming the locking parts of the two members of a plastic or other suitable non-current-carrying material. The male member has an inner current-carrying plug inserted into the current-carrying sleeve of the female member. Locking lugs are formed on the plastic or non-current-carrying cover of the plug, and cooperate with recesses in the plastic or non-current-carrying covering of the sleeve so that breakage or loss of one or more of such lugs or fracture of either covering will not interfere with current flow through the parts to ground.

Another feature is the provision of a very tight fit between the current-carrying plug and sleeve, which will make separation thereof more difficult, even when the two members are not in locked position and thereby aid in maintaining current flow. This is accomplished by providing a yieldable connection between the plug and sleeve to increase friction therebetween.

This may be done in several ways, but in the preferred form of the invention, the sleeve is provided with axially extending slots in the wall thereof. This permits the wall portions between the slots to be pressed together and reduce the inner diameter thereof to less than the diameter of the plug. The sleeve is retained in this condition by annular spring means which will yield when the plug is inserted, and thus provide increased friction rather than merely a slip fit. It is desirable also to provide a ring around the sleeve to limit the expansion thereof when the plug is inserted. Thus, when the locking means on the respective plastic parts of the two members are in locking engagement, the tight fit between the plug and sleeve will aid in preventing inadvertent relative rotation between the parts, and hence unlocking thereof, and will further aid in preventing separation of the two parts even if they should become inadvertently unlocked.

DETAILED DESCRIPTION OF THE INVENTION

Figures 1, 2, 3, 4, 5, 6, 7, 8, 9, 10:
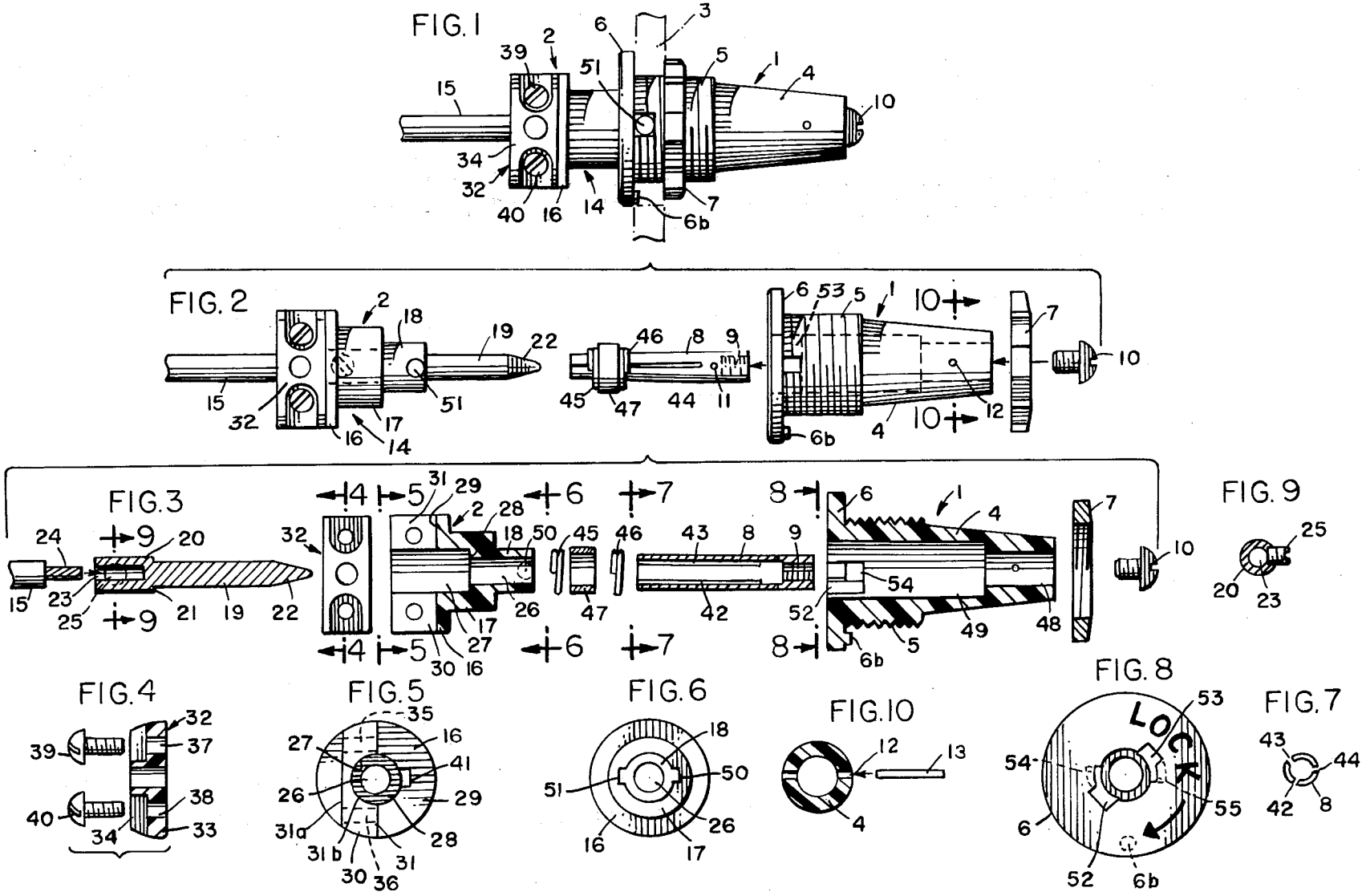
FIG. 1 is a side elevational view of the grounding jack of the present invention, showing the male and female members thereof in assembled relation.
FIG. 2 is an exploded side elevational view, showing the male and female members separated with the parts of the male member assembled, and certain parts of the female member separated.
FIG. 3 is an exploded view in longitudinal section showing all of the parts of both members disassembled.
FIG. 4 is a transverse, vertical sectional view of one of the parts, taken along the plane of line 4—4 of FIG. 3.
FIG. 5 is an end elevational view of a part of the plastic covering of the male member, taken along the plane of line 5—5 of FIG. 3.
FIG. 6 is an end elevational view taken along the plane of line 6—6 of FIG. 3, showing the opposite end of the part shown in FIG. 5.
FIG. 7 is an end elevational view of the current-carrying sleeve, taken along the plane of line 7—7 of FIG. 3.
FIG. 8 is an end elevational view of the plastic covering of the female member, taken along the plane of line 8—8 of FIG. 3.
FIG. 9 is a transverse sectional view through the current-carrying plug, taken along the plane of line 9—9 of FIG. 3.
FIG. 10 is a transverse sectional view through the plastic covering of the female member, taken along the plane of line 10—10 of FIG. 2.

Referring now, more particularly, to the drawing and especially to FIGS. 1, 2 and 3 thereof, the female member of the assembly is indicated, generally, by the numeral 1 and the male member is indicated, generally, by the numeral 2. As mentioned heretofore, it is preferable to use a receptacle cluster as the patient load center which has one or more grounding jacks. The jack is bussed together with the ground of the duplex receptacle. The numeral 3 in FIG. 1 identifies the cover of the wall-mounted box in which the female member of the assembly is mounted.

The numeral 4 represents the non-current carrying outer housing or covering of the female member, which has at one end thereof the threaded portion 5. The outer end of this housing or cover is provided with a flange member 6. In mounting the female member in the box, the cover 3 thereof is provided with an opening through which the member is inserted. The flanged end 6 will abut against the outer surface of the box cover 3 and, on the other side of the cover, there is provided a nut 7 threadedly engaging the threaded end 5 of the outer covering, which may be turned tightly against the inner surface of the wall-mounted box 3, thereby retaining the female portion of the assembly inside of the box. The flange 6 has a lug **6*b* extending axially thereof to be received in an opening in the cover 3** thereby to lock the female member against rotation.

Referring now, for a moment, to FIGS. 2 and 3, it will be noted that there is an internal sleeve 8 adapted to be inserted within the housing or covering 4 of the female member. As may be understood more clearly hereinafter, this sleeve 8 is a current-carrying member and is adapted to receive the current-carrying male member. One end of the sleeve 8 is provided with a threaded recess 9. When the sleeve is assembled within its housing, the threaded end 9 will be positioned at the smaller end of the non-current carrying housing 4 and will threadedly receive the screw 10, thereby retaining the sleeve 8 within its housing. It will also be noted that the sleeve 8 is provided with a transversely extending opening 11 which is to be brought into alignment with the transverse openings 12 in the walls of the housing, so that a retaining pin 13 may be inserted through the aligned openings 12 and 11, thereby to maintain the sleeve against rotation.

The insulated covering of the male member of the assembly is generally indicated by the numeral 14. It is adapted to have secured thereto a cable 15, electrically connected to the current-carrying male member, as will appear more fully hereinafter.

This male member 14 has an enlarged outer end provided with a flange member 16. Adjacent the flange 16, the male covering is provided with an intermediate portion 17 of smaller diameter and then terminates at its other end with a portion of still smaller diameter, indicated at 18. The male current-carrying pin or plug 19 is received within the body of the male member and protrudes outwardly from the inner end thereof to be received within the sleeve 8.

The opposite end of the current-carrying plug 19 is provided with a portion 20 of larger diameter, thereby providing an annular shoulder 21 between the main body of the pin 19 and the enlarged part 20. It will be noted that the end of the pin 19 is preferably tapered as indicated at 22 to facilitate entering the plug into the sleeve 8.

The outer end 20 of the plug 19 is provided with an axially extending bore 23 adapted to receive the conductor 24 protruding from the covering of cable 15. A retaining screw 25 is provided in threaded engagement with an opening in the enlarged end 20 so that when the conductor 24 is received within the bore 23 the retaining screw 25 may be tightened against the conductor so that it will be in current-carrying relation with the plug 19. This may also be seen in FIG. 9.

FIG. 3 illustrates the internal construction of the various members of the assembly and it will be noted there that the non-current carrying housing 14 of the male member is provided with an axially extending bore 26, having a portion 27 of larger diameter, thereby providing a shoulder 28 between the two portions 26 and 27.

The face 29 of the flange 16 is substantially flat, except for the portion 30 thereof which is an off center extension. The shape of this extension 30 may be seen by reference to FIGS. 3 and 5 wherein it will be noted that it is substantially rectangular. The side elevational view thereof in FIG. 3 shows that it is a rectangular extension in the axial direction and FIG. 5 shows that the outer face thereof is flat but that it has two flat faces 31 and **31*a*. It is also provided with a substantially semicircular recess 31*b* formed in the face 31, the curved surface of which is in alignment with the curved surface of the bore of larger diameter 27 so that in viewing the housing from the outer end thereof, as in FIG. 5, the shoulder 28** may be seen.

A clamp member 32 is shown in side elevation in FIG. 3 and in vertical section in FIG. 4. This clamp member likewise has a substantially rectangular configuration and is provided with a flat face 33 on one side thereof, and a similar flat face 34 on the opposite side thereof. The clamp member 32 serves to clamp the cable 15 in place by cooperating with the extension 30 on the face of the flange 16.

The face 33 of the clamp 32 is adapted to be brought into contact with the face 31 on the rectangular extension 30 after the cable and conductors have been brought into assembled relation with the plug 19 and the non-current carrying housing or covering of the male member. The extension 30 is provided with a pair of spaced, threaded openings 35 and 36, extending transversely thereof. The clamp member 32 is likewise provided with a pair of openings 37 and 38, adapted to be brought into alignment with the threaded openings 35 and 36, respectively, so that screws 39 and 40 may be inserted therethrough and threaded into the openings of the extension 30 thereby to clamp the cable 15 tightly therein.

In assembling the various parts of the male member, the conductor 24 is first inserted into the bore 23 at the outer end of the plug 19 and the set screw 25 is used to retain the cable in current conducting relation with the plug 19. The assembled plug 19 and cable 15 is then inserted into the non-current carrying housing or covering 14 and it is received therein by the axial bores 26 and 27. The shoulder 21 on the plug 19 is inserted a sufficient distance to abut against the shoulder 28 in the bore 26, thereby to limit movement of the plug through the housing. It may be noted from viewing FIG. 5, that the portion of the bore 27 of enlarged diameter is provided with an axially extending recess 41 for the purpose of receiving the set screw 25 which protrudes slightly from the enlarged end 20 of the plug 19, even after it has been tightened against the conductor, and prevents relative rotation between plug 19 and the housing or covering 14, and thus protects conductor 24.

After this part of the assembly procedure has been completed, a clamp member 32 is then applied to the surface 29 of the flange 16 and is brought against the face 31 of the extension 30. This will clamp the cable in place and application of the screws 39 and 40 thereto will assure retention of the cable in assembled relation, even when a force is exerted thereon to remove the plug from the female assembly.

As mentioned earlier, the sleeve 8 is so arranged as to snugly receive in a fairly tight relation, the plug 19. This result is preferably achieved by providing a yieldable connection between the plug and the sleeve. The preferred construction to achieve this result is by providing in the wall of the sleeve 8 a plurality of axially extending slots 42, 43, and 44. This may be seen more clearly by viewing FIG. 7. In FIG. 3, the slots 42 and 43 may be seen, while in FIG. 2, the slot 44 is shown. By reason of these slots, the wall portions therebetween may be compressed together so that the inner diameter of the sleeve will be made smaller than the diameter of the plug 19. A pair of coiled spring members or other suitable, yieldable means 45 and 46 are used to maintain the walls of the sleeve in their compressed condition, as may be noted by viewing FIG. 2. When the plug 19 is inserted into the sleeve 8, there will be an extremely tight fit, but one which is yieldable against the pressure of the spring means 45 and 46.

A restraining ring 47 is preferably located between the yieldable members 45 and 46 and surrounds the sleeve 8 adajcent the outer end thereof, in order to limit the spread of the wall portions between the slots when the plug is inserted therein. In this way, the walls will be prevented from being spread apart too far, and losing their ability to yieldably retain the plug in current-carrying relation with the sleeve.

In assembling this female member, the sleeve 8 has the walls thereof compressed so that the spring members 45 and 46 and the ring 47 may be applied thereto. The inherent resiliency of the walls of the sleeve will tend to expand them outwardly, but they will be restrained by the yieldable means. The outer non-current carrying housing or cover member 4 has an internal bore extending axially thereof which has a portion at one end indicated by the numeral 48 which is of substantially the same or slightly larger diameter than the sleeve 8 and is adapted to receive the sleeve therein. A portion of larger diameter, shown at 49, extends throughout the remainder of the housing 4 to the opposite end through the flange 6. The assembled sleeve is then inserted within the housing so that the openings 11 in the walls thereof will be brought into alignment with the openings 12 through the walls of the housing. At this time, the pin 13 is inserted, and frictionally held within the holes 12 and 11, thereby to prevent rotational movement of the sleeve. The screw 10 is then applied thereto in threaded engagement with the threaded bore 9 of the sleeve, and the female member thus has its assembly completed.

The inventive concept herein embodies, further, a pair of radially extending locking lugs 50 and 51, formed of an insulation or non-current carrying material and are preferably formed as an integral part of the end 18, of the non-current carrying housing 14 of the male member. These may be seen in elevation in FIG. 6, and one of them is shown in dotted lines in FIG. 3.

The outer face of the flange 6 on the non-current carrying housing of the female member has formed therein two diametrically opposed recesses 52 and 53, extending axially for a short distance. The inner end of each such recess joins with one end of an internal annular slot, such as indicated at 54 and 55.

Thus, the recesses 52 and 53 are adapted to receive the locking lugs 50 and 51 for locking engagement with the annular slots. When the grounding jack of the present invention is assembled for use, the current-carrying plug or pin 19 is inserted into the current-carrying sleeve 8 with the lugs 50 and 51 in alignment with the recesses 52 and 53. The plug is pressed inwardly until the lugs reach the bottom of the recesses and is then rotated until the lugs reach the ends of the annular slots.

The frictional engagement of the plug and sleeve will be sufficient to maintain the two parts in current-carrying contact with each other, and to maintain the locking lugs in locking engagement with the annular recess and against inadvertent rotation and removal.

Because the locking lugs are formed of an insulating material, they are not depended upon to carry current. It has been found under actual test conditions that if the plug is accidentally removed from the female members, such as by moving equipment against it, and one or both lugs are bent or broken, integrity of the current will not be lost when re-assembled by reason of the tight frictional engagement between the current-carrying members, which will be maintained.

Changes may be made in the form, construction and arrangement of parts from those disclosed herein without in any way departing from the spirit of the invention or sacrificing any of the attendant advantages thereof, provided, however, that such changes fall within the scope of the claims appended thereto.

I claim:

1. A grounding jack adapted for use in association with the wall-mounted box of a grounded electrical receptacle in patient load centers of hospitals, and the like, comprising a. a female portion including
   1. an elongated outer covering of insulation material terminating at one end thereof in an enlarged annular flange member having inner and outer faces,
   2. an inner current-carrying sleeve member fixed within said covering and adapted to be connected to ground, b. said female portion being adapted to be received within an opening in the cover of said wall-mounted box with the inner face of said flange member abutting against the outer surface of said cover, c. means to secure said female portion in place with respect to said box, d. a male portion including
   1. an elongated outer covering of insulation material, and
   2. an inner current-carrying plug member having one end thereof extending outwardly beyond one end of said covering and adapted to be snugly received within said current-carrying sleeve member in contact therewith, e. an axial slot in said flange member extending inwardly from the outer face thereof and communicating at the inner end thereof with an annular passage, f. a radially extending locking lug on the outer covering of said male portion adapted to be received in said axially extending slot in said flange member, said male and female portions being relatively rotatable when in assembled relation, so that said locking lug will traverse the associated annular passage to the locking position thereof.

2. The combination of elements defined in claim 1, wherein said sleeve member is slotted in the axial direction thereof thereby allowing the walls of said sleeve member to yield, annular spring means around said sleeve member normally holding the walls thereof in contracted condition, but permitting expansion thereof upon assembly with said plug member, thereby increasing the friction between said plug member and said sleeve member when assembled.

3. The combination of elements defined in claim 1, wherein said means to secure said female portion in place includes threads on the outer covering thereof adjacent the inner face of said flange member, and a nut engaging said threads adapted to be tightened against the inner surface of said cover of said box.

4. The combination of elements defined in claim 1, wherein said sleeve member is fixed within the outer covering thereof by means including aligned radially extending openings through the walls of said sleeve and the walls of said covering, and a retaining pin extending through all four of said openings.

* * * * *